US006280215B1

(12) United States Patent
Rice

(10) Patent No.: US 6,280,215 B1
(45) Date of Patent: Aug. 28, 2001

(54) ELECTRODE RECEPTACLE PLUG AND METHOD

(75) Inventor: Daniel W. Rice, Franklin, TN (US)

(73) Assignee: France/Scott Fetzer Company, Fairview, TN (US)

( * ) Notice: Subject to any disclaimer, the term of this patent is extended or adjusted under 35 U.S.C. 154(b) by 0 days.

(21) Appl. No.: 09/532,619

(22) Filed: Mar. 22, 2000

(51) Int. Cl.[7] ..... H01R 33/02; H01R 33/08
(52) U.S. Cl. ..... 439/230; 439/232
(58) Field of Search ..... 439/88, 230, 243, 439/274, 275, 587, 279; 362/316, 221, 267

(56) References Cited

U.S. PATENT DOCUMENTS

| | | | | |
|---|---|---|---|---|
| 4,133,593 | * | 1/1979 | Moulin | 439/274 |
| 4,444,446 | | 4/1984 | Hageman | 439/230 |
| 4,460,226 | | 7/1984 | Hageman | 439/241 |
| 4,713,021 | * | 12/1987 | Kobler | 439/272 |
| 4,842,535 | * | 6/1989 | Velke, Sr. et al. | 439/232 |
| 5,101,659 | * | 4/1992 | Takeuchi | 73/115 |
| 5,626,190 | * | 5/1997 | Moore | 166/65.1 |

OTHER PUBLICATIONS

"Neon Power Pro", http://www.neonpowerpro.com, revised May 1, 2000*.
"Neon Power Pro P–K Seal", http://www.neonpowerpro-.com/pkseal.html, *downloaded Jun. 22, 2000.

* cited by examiner

*Primary Examiner*—Brian Sircus
*Assistant Examiner*—Michael C. Zarroli
(74) *Attorney, Agent, or Firm*—Wood, Herron & Evans, L.L.P.

(57) ABSTRACT

An apparatus for an insulator tube in which a high-voltage conductor and an electrode of a high-voltage tube are connected. The insulator tube has a first end receiving the electrode, and the insulator tube is received by an open first end of a housing. The insulator tube and housing are connectable to mount the insulator tube and the housing to a structure. The apparatus is a plug having a tubular body adapted to extend through the opposite end of the insulator tube, and the plug has an inner ring within the tubular body adapted to receive and sealingly engage the high-voltage conductor. The plug also has outer rings extending from the tubular body that sealingly engage the insulator tube, thereby preventing moisture from exiting the insulator tube and causing a short circuit.

29 Claims, 2 Drawing Sheets

ELECTRODE RECEPTACLE PLUG AND METHOD

FIELD OF THE INVENTION

The present invention generally relates to electrical connectors and more particularly, to an improved electrical connector for a high-voltage gas filled tube, for example, a neon tube used for signage.

BACKGROUND OF THE INVENTION

High-voltage, gas filled tubes have been widely used for signage for decades. With such tubes, it is necessary to connect a high voltage conductor with a tube electrode inside an electrode receptacle. Such an electrode receptacle is subject to degraded performance due to moisture condensing in the receptacle finding its way to a ground outside the receptacle, thereby causing damage to the gas filled tube and its associated electrical circuits and components. A known connection of a gas filled tube, for example, a neon tube to a high voltage conductor is illustrated in FIG. 4. The neon tube 20 is mounted within a channel housing 22, for example, an aluminum casing, that supports a face or lens 24 through which the neon tube 20 is viewed. The neon tube 20 has an electrode 26 with an electrode contact 27 to which a high-voltage potential is supplied by means of a conductor or wire, for example, a high voltage gaseous tube and oil ignition ("GTO") cable, 28. The voltage is in the kilovolt range; and therefore, it is important that the connection between the cable 28 and the electrode 26 be easily made and further, that the connection be reliable over a period of use. In many applications, the connection between the electrode 26 and the high-voltage cable 28 is accomplished utilizing a known electrode receptacle 30 which is often implemented with a connector P-K connector. The electrode receptacle 30 is comprised of an outer protective housing, for example, a metal tube, 32 that is connected to an inner insulator tube, for example, a glass insert, 34 by means of respective threads 36*a,* 36*b*.

A mounting plate 38 supporting the channel housing 22 is mounted to a structure, for example, a surface, 40 often an exterior surface, of a wall 42. Thereafter, the insulator tube 34 is passed through a bore 44 within the mounting plate 38 and a hole 46 in the wall 42. The metal housing 32 is then inserted through the hole 46 of the wall 42 from an opposite side 48 and over the insulator tube 34. The metal housing 32 is then rotated with respect to the insulator tube 34 to engage the threads 36*a,* 36*b* on the housing 32 and tube 34, respectively. As the metal housing 32 is tightened, an end surface 50 of the housing 32 engages a gasket 52 located between the end surface 50 and a rear side 53 of the mounting plate 38. In addition, a mounting flange 54 on the open end of the insulator tube 34 presses against a gasket 56 and the front surface 58 of the mounting plate 38. Thus, the metal housing 32 and insulator tube 34 cooperate to securely mount the electrode receptacle 30 within the wall 42 to the mounting plate 38. Thereafter, the cable 28 is passed through openings 33, 90, in the respective closed ends 82, 35 of the insulator tube 34 and the metal housing 32. A spring contact 66 is then crimped onto the end of the cable 28 in a known manner and located on a shoulder 67 within the insulator tube 34. The cable 28 is carried within a conduit 60 mechanically connected via a conduit connector 62 to internal threads of a nut 64 on the bottom 35 of the metal housing 32. With the cable 28 secured within the electrode receptacle 30, the electrode 26 is inserted into the glass insulator tube 34, and its electrode contact 27 is pushed into contact with the spring contact 66, thereby providing a connection to the high-voltage cable 28. One or more tube supports 68 attached to the neon tube 20 are then fastened to the mounting plate 38 by known means.

The electrode receptacle 30 normally provides a reliable, high-voltage connection between the cable 28 and the electrode 26. However, over time, two failure conditions may arise. First, the thermal cycling of the neon tube 20 and the electrode receptacle 30 often results in the formation of condensation on the inside surface 70 of the insulator tube 34 or the metal housing 32. If moisture weeps along the outer surface of the cable 28, there is the potential for small current paths to be created between the spring contact 66 and ground, for example, the metal housing 32 and/or the conduit 60 and its connector 62. Depending on the extent of moisture on the cable 28, those current paths may be small or large, however, in any case, the current paths will cause a short circuit and failure in the lighting circuit.

A second problem with a typical electrode receptacle is that as the cable 28 passes through the bottom of the metal housing 32, for example, through the nut 64 and into the conduit 60, it is possible for the outer insulation of the cable 28 to be nicked or otherwise damaged by those metal components. For example, the nut 64 on the end of the metal housing 32 has internal threads that accept a threaded portion of a conduit connector 62. Any nick or other damage to the insulation of the cable 28 reduces the integrity and effectiveness of the insulating properties and, over time, often results in a failure and short circuit condition. In addition, any nicking or degradation of the insulation of the cable 28 is magnified by the presence of condensation or moisture on the outer surface of the cable 28 that also provides a low resistance current path to the metal housing 32 or conduit 60 and connector 62.

Therefore, there is a need for an improved connector housing a high-voltage connection between a high-voltage conductor and a gas filled tube, such as a neon tube.

SUMMARY OF THE INVENTION

The present invention provides an electrode receptacle that is less susceptible to short circuits that degrade the high voltage connection within the electrode receptacle. Thus, the present invention provides a more consistent, reliable and higher quality, high-voltage electrical connection within the electrode receptacle. The invention is especially useful in providing an electrical connection with a high-voltage, gas-filled tube used for signage in which the connection is exposed to a wide range of temperature and moisture conditions. In that regard, the invention provides an improved electrode receptacle in which moisture condensing within the electrode receptacle is prevented from contacting a ground, thereby preventing damage to the high voltage tube and its associated electrical circuits and components.

In accordance with the principles of the present invention and the described embodiments, an apparatus is provided for an insulator tube in which a high-voltage conductor and an electrode of a high-voltage tube are connected. The insulator tube has a first end receiving the electrode, and the insulator tube is received by an open first end of a housing. The insulator tube and housing are connectable to mount the insulator tube and the housing to a structure. The apparatus is a plug having a tubular body adapted to extend through the opposite end of the insulator tube, and the plug has an inner ring within the tubular body adapted to receive and sealingly engage the high-voltage conductor.

In one aspect of the invention, the inner ring is located near one end of the tubular body, and in another aspect of the invention, the inner ring is located on an end of the tubular body extending inside the insulator tube. In a further aspect of the invention, the tubular body has an opposite end extending through an opposite end of the housing.

In another embodiment, the present invention includes a method of reducing short circuits between ground and an interior of the insulator tube by preventing liquid from leaving an interior of the insulator tube through the opposite end of the insulator tube.

The sealing plug of the present invention effectively isolates moisture on the interior of the insulator tube from grounded components such as the housing. By isolating any condensate or moisture within the insulator tube and preventing its escape or weeping along the outer surface of the conductor, the plug of the present invention minimizes and most often prevents short circuits caused by such condensate or moisture. Thus, the sealing plug of the present invention has the advantage of substantially increasing the reliable operation and maintenance free useful life of the electrode receptacle, the neon tube and its associated electrical circuits and components.

Various additional advantages, objects and features of the invention will become more readily apparent to those of ordinary skill in the art upon consideration of the following detailed description of the presently preferred embodiments taken in conjunction with the accompanying drawings.

DETAILED DESCRIPTION OF THE INVENTION

Figure 1:
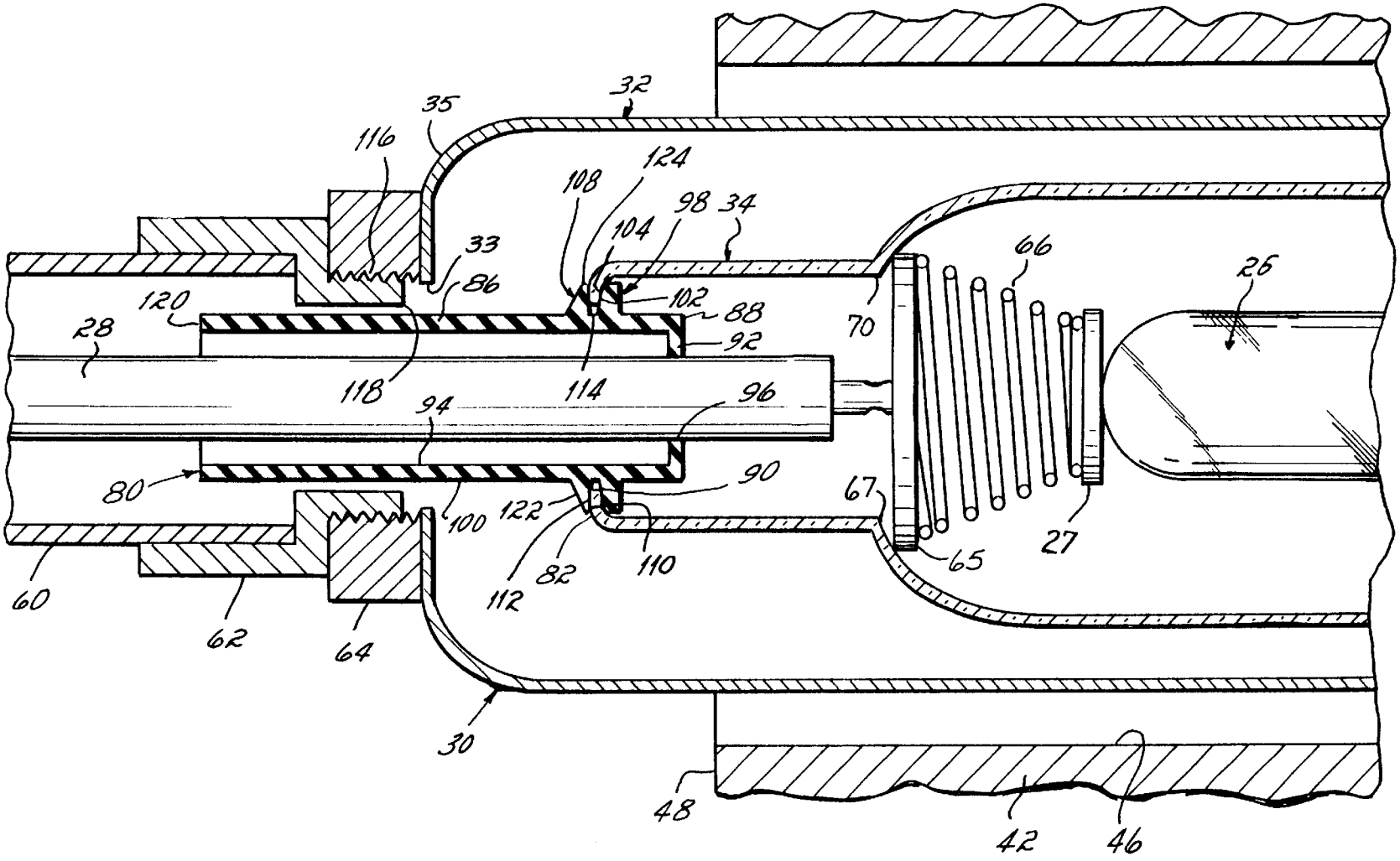
FIG. 1 is a partial side cross-section view of an electrode receptacle utilizing a plug in accordance with the principles of the present invention.
Figure 2:
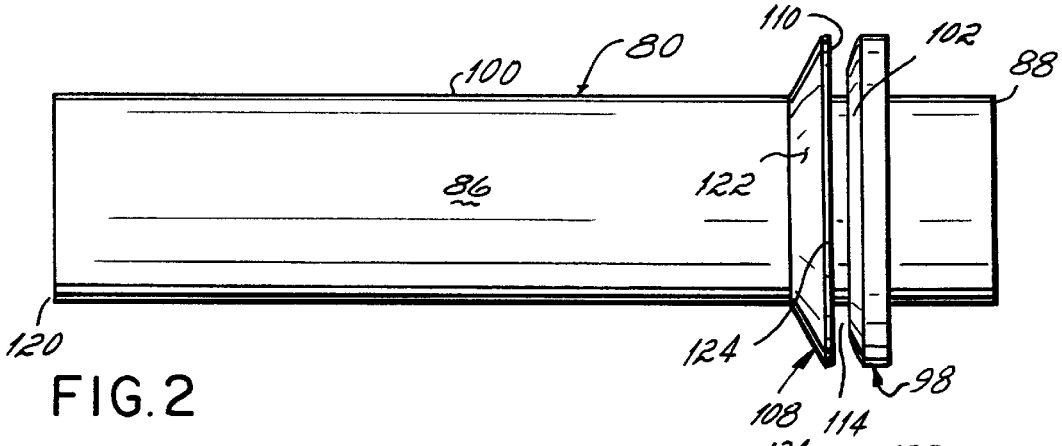
FIG. 2 is an enlarged side elevation view of the plug illustrated in FIG. 1.
Figure 3:
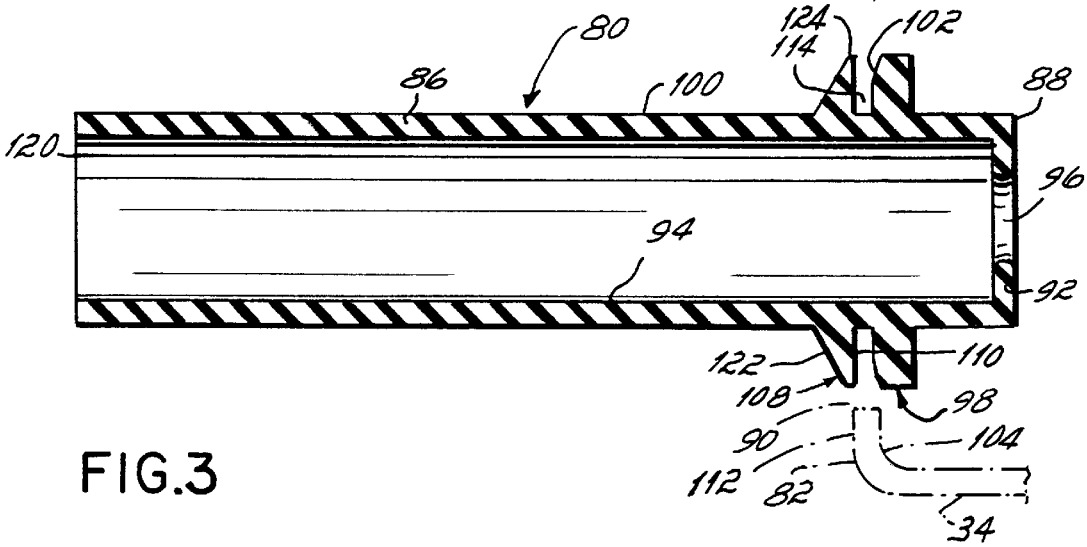
FIG. 3 is an enlarged cross-section view of the plug and the electrode receptacle illustrated in FIG. 1.
Figure 4:
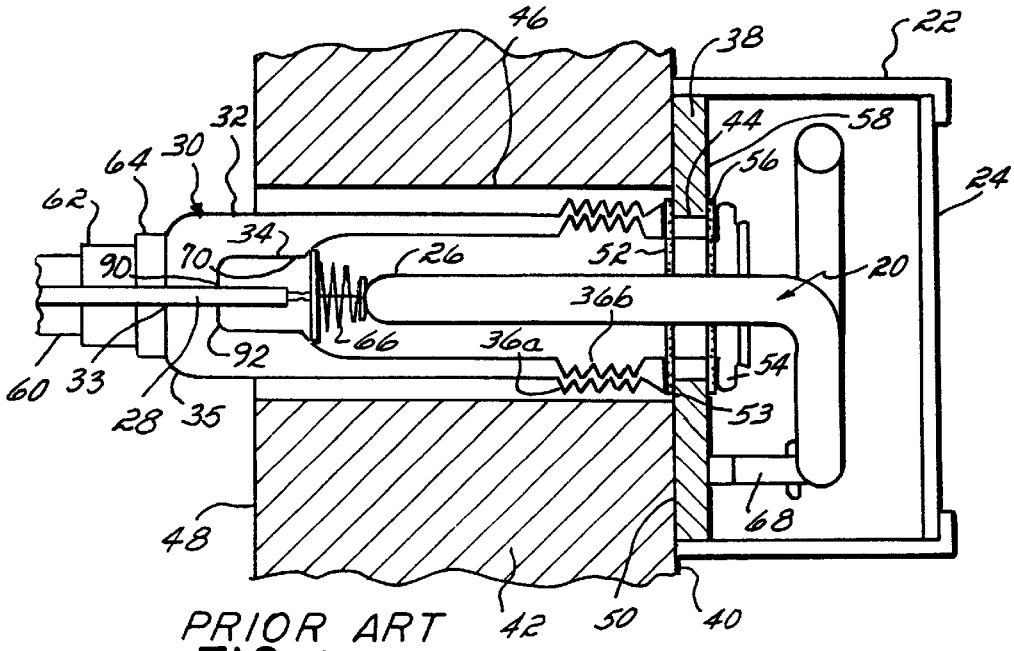
PRIOR ART FIG. 4
FIG. 4 is a partial side cross-section view of a known the electrode receptacle installed in a wall.

Referring to FIGS. 1–3, the present invention utilizes a sealing plug 80 mounted on the bottom end 82 of the insulator tube 34. The plug 80 has a generally tubular, hollow body 86 with an inner end 88 extending through a hole 90 on the bottom end 82 of the insulator tube 34. An annular inner ring 92 extends from an inner surface 94 of the tubular body 86. The inner ring 92 has a center hole, or opening, 96 that receives the conductor 28 and sealingly engages the outer surface of the conductor 28. The opening 96 has a diameter less than the diameter of the conductor 28 and therefore, tightly compresses against the conductor 28 to form a tight liquid seal.

The plug has a first outer ring 98 extending from an outer surface 100 of the tubular body 86. The outer ring 98 has an inner surface 102 with a contour that generally matches the contour of the inner surface 104 of the bottom 82 of the insulator tube 34. Thus, the surface 102 provides an annular sealing area against the surface 104. A second outer ring 108 extends outwardly from the outer surface 100 of the tubular body 86. The second outer ring 108 has an annular inner surface 110 with a contour matching the contour of the outer surface 112 of the bottom wall 82 of the insulator tube 34. Thus, the inner surface 110 forms an annular sealing area with an outer surface 112 of the bottom 82 of the insulator tube 34. The first and second outer rings 98, 108 have adjacent respective inner surfaces 102, 110 that form a groove 114 therebetween. The groove 114 captures and provides a seal with an annular portion of the bottom wall 82 surrounding the opening 90 of the insulator tube 34.

The tubular body 86 of the plug 80 has a length that extends past the threads 116 of the nut 64 as well as the sharp inner edges 118 of the conduit connector 62. The tubular body 86 has an outer end 120 that terminates inside the conduit 60 at a location beyond the connector 62 and nut 64.

In use, after the glass insulator tube has been processed to form the hole 90 therein, the tubular body 86 of the plug 80 is inserted through the hole 90 from the interior of the insulator tube 34. The tubular body is held at the outer end 120 and pulled until the second outer ring 108 is forced through the hole 90. The second outer ring 108 has an angled annular surface 122 extending outward from the tubular body 86 toward the inner end 88. Further, the second outer ring 108 tapers to a thin edge 124 as the surface 122 moves outward from the body 86. Thus, when the plug 80 is being pulled through the hole 90, the profile of the second outer ring 108 facilitates the ring 108 being pushed back into the groove 114 and providing a diameter such that the ring 108 can be squeezed through the hole 90 of the bottom 82 of the insulator tube 34.

In contrast, the first outer ring 98 has a relatively thick cross section and is therefore, relatively stiff and not flexible. Thus, the first outer ring 98 provides a relatively strong stop that resists any further motion of the plug 80 as it is being pulled through the hole 90. The first and second outer rings 98, 108 form a groove 114 that has a width that is less than the thickness of the bottom wall 82 of the insulator tube 34. Thus, when the plug 80 is installed, the first and second outer rings 98, 108 stretch around the respective inner and outer surfaces 104, 112 of the bottom wall 82 of the insulator tube 34, thereby forming a liquid tight seal therewith. It should be also noted that the groove 114 is sufficiently deep to sealingly receive the bottom wall 82 over the full range of manufacturing tolerances of the bottom wall 82.

Thereafter, the high-voltage conductor 28 is inserted into the outer end 120 of tubular body 86 and then through the opening 96 in the inner sealing wall 92 of the plug 80. The smaller diameter of the opening 96 provides a liquid tight seal with respect to the outer surface of the conductor 28. The spring contact 66 is then crimped onto the end of the cable 28 in a known manner, and the base 65 of the spring contact 66 is located on a shoulder 67 within the insulator tube 34. As the conductor 28 is passed through the hollow, tubular body 86, it is protected from any damaging contact with the threads 116 or the edges 118 of the conduit connector 62 and nut 64.

The cylindrical, hollow sealing plug 80 may be made from any material that provides a seal with the conductor 28 and the bottom 82 of the insulator tube 34. For example, the plug 80 may be made from a silicone rubber material. Silicone rubber has excellent sealing properties and in addition, is highly flexible and durable over the useful life of the electrode receptacle 30.

The sealing plug of the present invention is effective to isolate any moisture on the interior of the insulator tube 34 from grounded components such as the metal housing 32, conduit 60 and conduit connector 62. By isolating any condensate or moisture within the insulator tube 34 and preventing its escape or weeping along the outer surface of the conductor 28, the sealing plug 80 minimizes and most often prevents any short circuit caused by such condensate or moisture from occurring. Thus, the sealing plug of the present invention has the advantage of substantially increasing the reliable operation and maintenance free useful life of the neon tube 20 and its associated electrical circuits and components.

While the present invention has been illustrated by a description of various preferred embodiments and while these embodiments have been described in considerable detail in order to describe the best mode of practicing the invention, it is not the intention of Applicant to restrict or in any way limit the scope of the appended claims to such detail. Additional advantages and modifications within the spirit and scope of the invention will readily appear to those skilled in the art. For example, in the described embodiment, the inner ring 92 is shown as being on the inner end 88 of the tubular body 100. As will be appreciated, the inner sealing ring 92 may be located at any position along the interior length of the tubular body 80. For example, the inner ring 92 may be located on the outer end 120 of the tubular body 100, near one of the ends 88, 120 of the tubular body 100 or at any point intermediate the ends 88, 120.

Therefore, the invention in its broadest aspects is not limited to the specific detail shown and described. Consequently, departures may be made from the details described herein without departing from the spirit and scope of the claims which follow.

What is claimed is:

1. An apparatus for an insulator tube containing a connection between a high-voltage conductor and an electrode of a high-voltage tube, the insulator tube having a first end receiving the electrode and an opposite end, the insulator tube being received by an open first end of a housing and connectable with the housing to mount the insulator tube and the housing to a structure, the apparatus comprising:

a plug having a tubular body adapted to extend through the opposite end of the insulator tube; and an inner ring within the tubular body adapted to receive and sealingly engage the high-voltage conductor, thereby reducing a potential for arcing by preventing moisture inside the insulator tube from escaping therefrom.

2. The apparatus of claim 1 wherein the inner ring extends from an inner surface within the tubular body and is located proximate the inner end.

3. The apparatus of claim 1 wherein the inner ring extends from an inner surface within the tubular body and is located on the inner end.

4. The apparatus of claim 1 further comprising an outer ring extending from an outer surface of the tubular body and adapted to sealingly engage an inner surface of the opposite end of the insulator tube.

5. The apparatus of claim 1 further comprising an outer ring extending from an outer surface of the tubular body and adapted to sealingly engage an outer surface of the opposite end of the insulator tube.

6. The apparatus of claim 1 further comprising:

a first outer ring extending from an outer surface of the tubular body and adapted to sealingly engage an inner surface of the opposite end of the insulator tube; and a second outer ring extending from an outer surface of the tubular body and adapted to sealing engage an outer surface of the opposite end of the insulator tube.

7. The apparatus of claim 6 wherein the first outer ring has an inner surface with a contour generally matching the contour of the inner surface of the opposite end of the insulator tube.

8. The apparatus of claim 7 wherein the second outer ring has an inner surface with a contour generally matching the contour of the outer surface of the opposite end of the insulator tube.

9. The apparatus of claim 8 wherein the plug has an inner end located within the insulator tube.

10. The apparatus of claim 9 wherein the first outer ring has a cross-sectional shape resisting a bending of the first outer ring.

11. The apparatus of claim 9 wherein the second outer ring angles outward away from the outer surface of the tubular body toward the inner end of the plug.

12. The apparatus of claim 9 wherein the second outer ring has a cross-sectional shape facilitating a bending of the second outer ring toward the inner end of the insulator tube.

13. The apparatus of claim 1 wherein the first and second outer rings are located adjacent each other and form a groove therebetween adapted to receive a wall of the insulator tube.

14. The apparatus of claim 1 wherein the tubular body has an outer end adapted to extend through an opposite end of the housing.

15. The apparatus of claim 14 wherein the housing has internal threads at its opposite end, and the outer end of the tubular body extends past the internal threads in the opposite end of the housing.

16. The apparatus of claim 14 wherein the housing is connected to one end of a conduit at its opposite end, and the tubular body has a length such that the outer end is adapted to extend into the conduit.

17. The apparatus of claim 1 wherein the plug is made from a silicone rubber material.

18. A connector for supporting an electrical connection between an electrode of a high-voltage tube and a high-voltage conductor comprising:

an insulator tube having a first opening adapted to receive the electrode and a second opening;

a housing having a first opening for receiving the insulator tube and a second opening, the housing and the insulator tube being connectable to mount an assembly of the tube and the insulator tube to a structure; and a tubular plug having an inner end extending through the second opening of the insulator tube, an inner ring adapted to receive and sealingly engage the high-voltage conductor to prevent moisture from flowing through the tubular plug, and an outer end extending through the second opening in the housing and over the high-voltage conductor to prevent injury to the high-voltage conductor.

19. A method of reducing a potential for arcing and short circuits between ground and an interior of an insulator tube containing a connection between a high-voltage conductor and an electrode of a high-voltage tube, the insulator tube having a first end receiving the electrode and the insulator tube being received by an open first end of a housing and connectable in an assembly, the insulator tube and housing having respective opposite ends receiving the high-voltage conductor, the method comprising preventing liquid from leaving an interior of the insulator tube through the opposite end of the insulator tube.

20. The method of claim 19 further comprising sealing between and exterior surface of the high-voltage conductor and a surface on the interior of the insulator tube.

21. The method of claim 19 further comprising sealing between an exterior surface of the high-voltage conductor and an exterior surface of the insulator tube.

22. The method of claim 19 further comprising sealing between an exterior surface of the high-voltage conductor and both an exterior surface of the insulator tube and a surface on the interior of the insulator tube.

23. The method of claim 19 further comprising locating a barrier between an exterior of the high-voltage conductor and an interior surface of the housing.

24. The method of claim 19 further comprising locating a barrier between an exterior of the high-voltage conductor and an interior surface of the housing and conduit connected to the housing.

25. A method of reducing a potential for arcing and short circuits between ground and an interior of an insulator tube containing a connection between a high-voltage conductor and an electrode of a high-voltage tube inserting a plug in a hole in a partially closed end of the insulator tube, the insulator tube having a first end receiving the electrode;

inserting the insulator tube in an end of a housing, the housing being connectable to the insulator tube;

inserting the plug in a hole in a closed end of the housing;

inserting a high-voltage conductor through a centerbore of the plug; and blocking passage of moisture along the exterior surface of the conductor from an interior to an exterior of the insulator tube.

26. An apparatus for an insulator tube containing a connection between a high-voltage conductor and an electrode of a high-voltage tube, the insulator tube having a first end receiving the electrode and an opposite end, the insulator tube being received by an open first end of a housing and connectable with the housing to mount the insulator tube and the housing to a structure, the apparatus comprising:

a plug having a tubular body adapted to extend through the opposite end of the insulator tube; and an inner ring within the tubular body adapted to receive and sealingly engage the high-voltage conductor, wherein the inner ring extends from an inner surface within the tubular body and is located proximate an inner end of the plug.

27. An apparatus for an insulator tube containing a connection between a high-voltage conductor and an electrode of a high-voltage tube, the insulator tube having a first end receiving the electrode and an opposite end, the insulator tube being received by an open first end of a housing and connectable with the housing to mount the insulator tube and the housing to a structure, the apparatus comprising:

a plug having a tubular body adapted to extend through the opposite end of the insulator tube;

an inner ring within the tubular body adapted to receive and sealingly engage the high-voltage conductor; and an outer ring extending from an outer surface of the tubular body and adapted to sealingly engage an inner surface of the opposite end of the insulator tube.

28. An apparatus for an insulator tube containing a connection between a high-voltage conductor and an electrode of a high-voltage tube, the insulator tube having a first end receiving the electrode and an opposite end, the insulator tube being received by an open first end of a housing and connectable with the housing to mount the insulator tube and the housing to a structure, the apparatus comprising:

a plug having a tubular body adapted to extend through the opposite end of the insulator tube; and an inner ring within the tubular body adapted to receive and sealingly engage the high-voltage conductor;

a first outer ring extending from an outer surface of the tubular body and adapted to sealingly engage an inner surface of the opposite end of the insulator tube; and a second outer ring extending from an outer surface of the tubular body and adapted to sealingly engage an outer surface of the opposite end of the insulator tube.

29. An apparatus for an insulator tube containing a connection between a high-voltage conductor and an electrode of a high-voltage tube, the insulator tube having a first end receiving the electrode and an opposite end, the insulator tube being received by an open first end of a housing and connectable with the housing to mount the insulator tube and the housing to a structure, the housing having internal threads at an opposite end, the apparatus comprising:

a plug having a tubular body adapted to extend through the opposite end of the insulator tube, the tubular body having an outer end adapted to extend through the opposite end of the housing and past the internal threads; and an inner ring within the tubular body adapted to receive and sealingly engage the high-voltage conductor.

* * * * *

UNITED STATES PATENT AND TRADEMARK OFFICE

CERTIFICATE OF CORRECTION

PATENT NO. : 6,280,215 B1
DATED : August 28, 2001
INVENTOR(S) : Daniel W. Rice

It is certified that error appears in the above-identified patent and that said Letters Patent is hereby corrected as shown below:

Column 3,
Line 40, delete "the".

Column 5,
Line 62, delete "sealing", insert -- sealingly --.

Column 6,
Line 61, delete "and", insert -- an --.

Column 7,
Line 13, after tube, insert -- comprising: --.

Signed and Sealed this

Seventh Day of May, 2002

*Attest:*

*Attesting Officer*

JAMES E. ROGAN
*Director of the United States Patent and Trademark Office*